US011670217B2

(12) United States Patent
Baek et al.

(10) Patent No.: US 11,670,217 B2
(45) Date of Patent: Jun. 6, 2023

(54) DISPLAY APPARATUS AND METHOD OF DRIVING THE SAME

(71) Applicant: Samsung Display Co., Ltd., Yongin-Si (KR)

(72) Inventors: Yunki Baek, Suwon-si (KR); Manseung Cho, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/381,529

(22) Filed: Jul. 21, 2021

(65) Prior Publication Data

US 2022/0139292 A1 May 5, 2022

(30) Foreign Application Priority Data

Nov. 2, 2020 (KR) ..... 10-2020-0144733

(51) Int. Cl.
*G09G 3/20* (2006.01)

(52) U.S. Cl.
CPC ..... *G09G 3/2092* (2013.01); *G09G 2300/026* (2013.01); *G09G 2310/0289* (2013.01); *G09G 2320/0233* (2013.01); *G09G 2320/0242* (2013.01); *G09G 2320/0693* (2013.01); *G09G 2330/028* (2013.01); *G09G 2330/12* (2013.01)

(58) Field of Classification Search
CPC ..... G06F 3/1423–1446; G09G 3/2092; G09G 3/32–3291; G09G 2300/02–026; G09G 2300/0426; G09G 2300/043; G09G 2310/0243; G09G 2310/0264; G09G 2310/0289; G09G 2310/06; G09G 2310/08; G09G 2320/02; G09G 2320/0204; G09G 2320/0223; G09G 2320/0233; G09G 2320/0238; G09G 2320/029; G09G 2320/0626; G09G 2320/066; G09G 2320/0686; G09G 2320/0693; G09G 2330/02; G09G 2330/028; G09G 2330/12
See application file for complete search history.

(56) References Cited

U.S. PATENT DOCUMENTS 5,831,709 A * 11/1998 Song ..... G09G 3/3655 349/149
6,498,592 B1 * 12/2002 Matthies ..... H01L 27/3288 345/55
10,674,632 B2 6/2020 Park et al.
(Continued)

FOREIGN PATENT DOCUMENTS

KR 101836543 B1 3/2018
KR 1020190009022 A 1/2019
(Continued)

*Primary Examiner* — Nathan Danielsen
(74) *Attorney, Agent, or Firm* — Cantor Colburn LLP

(57) ABSTRACT

A display apparatus includes a plurality of display panels, a power voltage generator and a driving controller. The power voltage generator generates power voltages of the plurality of display panels. The driving controller receives the power voltages from feedback points of the plurality of display panels and generates a control signal and controls levels of the power voltages based on fed-back power voltages from the feedback points of the plurality of display panels. The power voltage generator adjusts the levels of the power voltages and generates compensation power voltages based on the control signal.

18 Claims, 9 Drawing Sheets

(56) References Cited

U.S. PATENT DOCUMENTS

| | | | | |
|---|---|---|---|---|
| 2005/0134525 | A1* | 6/2005 | Tanghe | G06F 3/1446 345/1.1 |
| 2017/0270896 | A1* | 9/2017 | Cope | G09G 5/02 |
| 2020/0043402 | A1* | 2/2020 | Omid-Zohoor | G09G 3/32 |
| 2020/0090572 | A1* | 3/2020 | Wu | G09G 3/20 |
| 2020/0126476 | A1* | 4/2020 | Joo | G06F 3/1446 |
| 2020/0273423 | A1* | 8/2020 | Okada | G09G 3/3696 |

FOREIGN PATENT DOCUMENTS

| | | | |
|---|---|---|---|
| KR | 102061554 | B1 | 1/2020 |
| KR | 1020200065383 | A | 6/2020 |
| KR | 1020200088935 | A | 7/2020 |
| KR | 1020200089385 | A | 7/2020 |

* cited by examiner

DISPLAY APPARATUS AND METHOD OF DRIVING THE SAME

This application claims priority to Korean Patent Application No. 10-2020-0144733, filed on Nov. 2, 2020, and all the benefits accruing therefrom under 35 U.S.C. § 119, the content of which in its entirety is herein incorporated by reference.

BACKGROUND

1. Field

Embodiments of the invention relate to a display apparatus and a method of driving the display apparatus. More particularly, embodiments of the invention relate to a display apparatus including a plurality of display panels and compensating a disuniformity of luminances and a disuniformity of color deviations generated at boundaries of the display panels and a method of driving the display apparatus.

2. Description of the Related Art

Recently, interest in display apparatuses is increasing. Accordingly, various types of the display apparatuses is manufactured in various types such as an organic light emitting diode ("OLED") display apparatus and a liquid crystal display ("LCD") apparatus.

In addition, a study is being conducted to enlarge the display apparatuses. An enlarged display apparatus may include a plurality of display panels. The display apparatus may include a tiled display apparatus which combines a plurality of display panels to form one display apparatus, for example.

SUMMARY

A difference of luminance differences and a difference of color deviations may be generated at boundaries of a display panels in a tiled display apparatus due to a difference of levels of power voltages. Embodiments of the invention provide a display apparatus compensating a difference of luminances and a difference of color deviations generated at boundaries of display panels to enhance a display quality of the display apparatus.

Embodiments of the invention also provide a method of driving the display apparatus.

In an embodiment of a display apparatus according to the invention, the display apparatus includes a plurality of display panels, a power voltage generator and a driving controller. The power voltage generator generates power voltages of the plurality of display panels. The driving controller receives the power voltages from feedback points of the plurality of display panels and generates a control signal to control levels of the power voltages based on fed-back power voltages from the feedback points of the plurality of display panels. The power voltage generator adjusts the levels of the power voltages and generates compensation power voltages based on the control signal.

In an embodiment, the plurality of display panels may include a first display panel, a second display panel, a third display panel and a fourth display panel which are disposed in two rows and two columns. The driving controller may receive a first feedback power voltage from the first display panel, a second feedback power voltage from the second display panel, a third feedback power voltage from the third display panel and a fourth feedback power voltage from the fourth display panel.

In an embodiment, a first feedback point of the first display panel may be disposed at a corner portion of the first display panel. The corner portion of the first display panel may be adjacent to the second display panel, the third display panel and the fourth display panel.

In an embodiment, the second display panel may be disposed adjacent to the first display panel in a first direction, the third display panel may be disposed adjacent to the first display panel in a second direction different from the first direction, and the fourth display panel may be disposed adjacent to the third display panel in the first direction. A first power voltage may be applied from a first corner portion of the first display panel to a second corner portion of the first display panel where the second corner portion of the first display panel is adjacent to the second, third and fourth display panels and the first corner portion of the first display panel is opposite to the second corner portion of the first display panel in a third direction between the first and second directions, a second power voltage may be applied from a first corner portion of the second display panel to a second corner portion of the second display panel where the first corner portion of the second display panel is adjacent to the first display panel and aligned with the first corner portion of the first display panel in the first direction, and the second corner portion of the second display panel is opposite to the first corner portion of the second display panel in the third direction, a third power voltage may be applied from a first corner portion of the third display panel to a second corner portion of the third display panel where the second corner portion of the third display panel is adjacent to the first display panel and aligned with the first corner portion of the first display panel in the second direction, and the first corner portion of the third display panel is opposite to the second corner portion of the third display panel in the third direction, and a fourth power voltage may be applied from a first corner portion of the fourth display panel to a second corner portion of the fourth display panel where the second corner portion of the fourth display panel is adjacent to the second display panel and aligned with the first corner portion of the second display panel in the second direction, and the first corner portion of the fourth display panel is opposite to the second corner portion of the fourth display panel in the third direction.

In an embodiment, the second display panel may be disposed adjacent to the first display panel in a first direction, the third display panel may be disposed adjacent to the first display panel in a second direction different from the first direction, and the fourth display panel may be disposed adjacent to the third display panel in the first direction. A first power voltage may be applied from a first corner portion of the first display panel to a second corner portion of the first display panel where the second corner portion of the first display panel is adjacent to the second, third and fourth display panels and the first corner portion of the first display panel is opposite to the second corner portion of the first display panel in a third direction between the first and second directions, a second power voltage may be applied from a first corner portion of the second display panel to a second corner portion of the second display panel where the second corner portion of the second display panel is adjacent to the first, third and fourth display panels and the first corner portion of the second display panel is opposite to the first corner portion of the second display panel in the third direction, a third power voltage may be applied from a first corner portion of the third display panel to a second corner portion of the third display panel where the second corner portion of the third display panel is adjacent to the first, second and fourth display panels and the first corner portion of the third display panel is opposite to the first corner portion of the second display panel in the third direction, and a fourth power voltage may be applied from a first corner portion of the fourth display panel to a second corner portion of the fourth display panel where the second corner portion of the fourth display panel is adjacent to the first, second and third display panels and the first corner portion of the fourth display panel is opposite to the first corner portion of the second display panel in the third direction.

In an embodiment, the display apparatus may further include a first level shifter which shifts a level of the first feedback power voltage and outputs a level-shifted first feedback power voltage to the driving controller, a second level shifter which shifts a level of the second feedback power voltage and outputs a level-shifted second feedback power voltage to the driving controller, a third level shifter which shifts a level of the third feedback power voltage and outputs a level-shifted third feedback power voltage to the driving controller and a fourth level shifter which shifts a level of the fourth feedback power voltage and outputs a level-shifted fourth feedback power voltage to the driving controller.

In an embodiment, the driving controller may output the control signal to the power voltage generator. The power voltage generator may generate a first compensation power voltage based on the control signal and to output the first compensation power voltage to the first display panel. The power voltage generator may generate a second compensation power voltage based on the control signal and to output the second compensation power voltage to the second display panel. The power voltage generator may generate a third compensation power voltage based on the control signal and to output the third compensation power voltage to the third display panel. The power voltage generator may generate a fourth compensation power voltage based on the control signal and to output the fourth compensation power voltage to the fourth display panel.

In an embodiment, the driving controller may output a first control signal, a second control signal, a third control signal and a fourth control signal. The power voltage generator may include a first power voltage generator which generates a first compensation power voltage based on the first control signal and outputs the first compensation power voltage to the first display panel, a second power voltage generator which generates a second compensation power voltage based on the second control signal and outputs the second compensation power voltage to the second display panel, a third power voltage generator which generates a third compensation power voltage based on the third control signal and outputs the third compensation power voltage to the third display panel and a fourth power voltage generator which generates a fourth compensation power voltage based on the fourth control signal and outputs the fourth compensation power voltage to the fourth display panel.

In an embodiment, the driving controller may determine a maximum voltage among the fed-back power voltages as a target value. The power voltage generator may increase levels of the compensation power voltages corresponding to the fed-back power voltages less than the maximum voltage based on the target value.

In an embodiment, the driving controller may determine a target value which is greater than a maximum voltage among the fed-back power voltages. The power voltage generator may increase levels of the compensation power voltages based on the target value.

In an embodiment, the display apparatus may further include a level shifter which receives the fed-back power voltage, shifts a level of the fed-back power voltage and outputs a level-shifted power voltage to the driving controller.

In an embodiment, the display panel may include a plurality of pixels. A high power voltage and a low power voltage may be applied to the pixels. The power voltage may be the high power voltage applied to the pixels.

In an embodiment of a display apparatus according to the invention, the display apparatus includes a plurality of display panels and a power voltage generator. The power voltage generator generates power voltages of the plurality of display panels. The power voltage generator receives the power voltages from feedback points of the plurality of display panels and adjusts levels of the power voltages to generate compensation power voltages based on fed-back power voltages from the feedback points of the plurality of display panels.

In an embodiment, the plurality of display panels may include a first display panel, a second display panel, a third display panel and a fourth display panel which are disposed in two rows and two columns. The power voltage generator may receive a first feedback power voltage from the first display panel, a second feedback power voltage from the second display panel, a third feedback power voltage from the third display panel and a fourth feedback power voltage from the fourth display panel.

In an embodiment, a first feedback point of the first display panel may be disposed at a corner portion of the first display panel. The corner portion of the first display panel may be adjacent to the second display panel, the third display panel and the fourth display panel.

In an embodiment of a method of driving a display apparatus comprising a plurality of display panels according to the invention, the method includes generating power voltages of the display panels, outputting the power voltages to the plurality of display panels, receiving the power voltages from feedback points of the plurality of display panels, generating a control signal to control levels of the power voltages based on fed-back power voltages from the feedback points of the plurality of display panels, adjusting the levels of the power voltages to generate compensation power voltages based on the control signal and outputting the compensation power voltages to the plurality of display panels.

In an embodiment, the method may further include determining a maximum voltage among the fed-back power voltages as a target value. Levels of the compensation power voltages corresponding to the fed-back power voltages less than the maximum voltage may be increased based on the target value.

In an embodiment, the method may further include determining a target value which is greater than a maximum voltage among the fed-back power voltages. Levels of the compensation power voltages may be increased based on the target value.

In an embodiment, the method may further include shifting a level of the feedback power voltage and outputting a level-shifted power voltage to a driving controller.

In an embodiment, the display panel may include a plurality of pixels. A high power voltage and a low power voltage may be applied to the pixels. The power voltage may be the high power voltage applied to the pixels.

According to the display apparatus and the method of driving the display apparatus, the power voltages are fed back at the boundaries of the plurality of display panels, the control signal to control the levels of the power voltages are generated based on the fed-back power voltages and the levels of the power voltages are adjusted to generate the compensation power voltages based on the control signal in the display apparatus including the plurality of display panels.

Accordingly, the difference of the luminances and the difference of the color deviations generated at the boundaries of display panels may be compensated. Thus, the display quality of the display apparatus including the plurality of display panels may be enhanced.

BRIEF DESCRIPTION OF THE DRAWINGS

The above and other features and advantages of the invention will become more apparent by describing in detailed embodiments thereof with reference to the accompanying drawings, in which.

DETAILED DESCRIPTION

Figure 1:
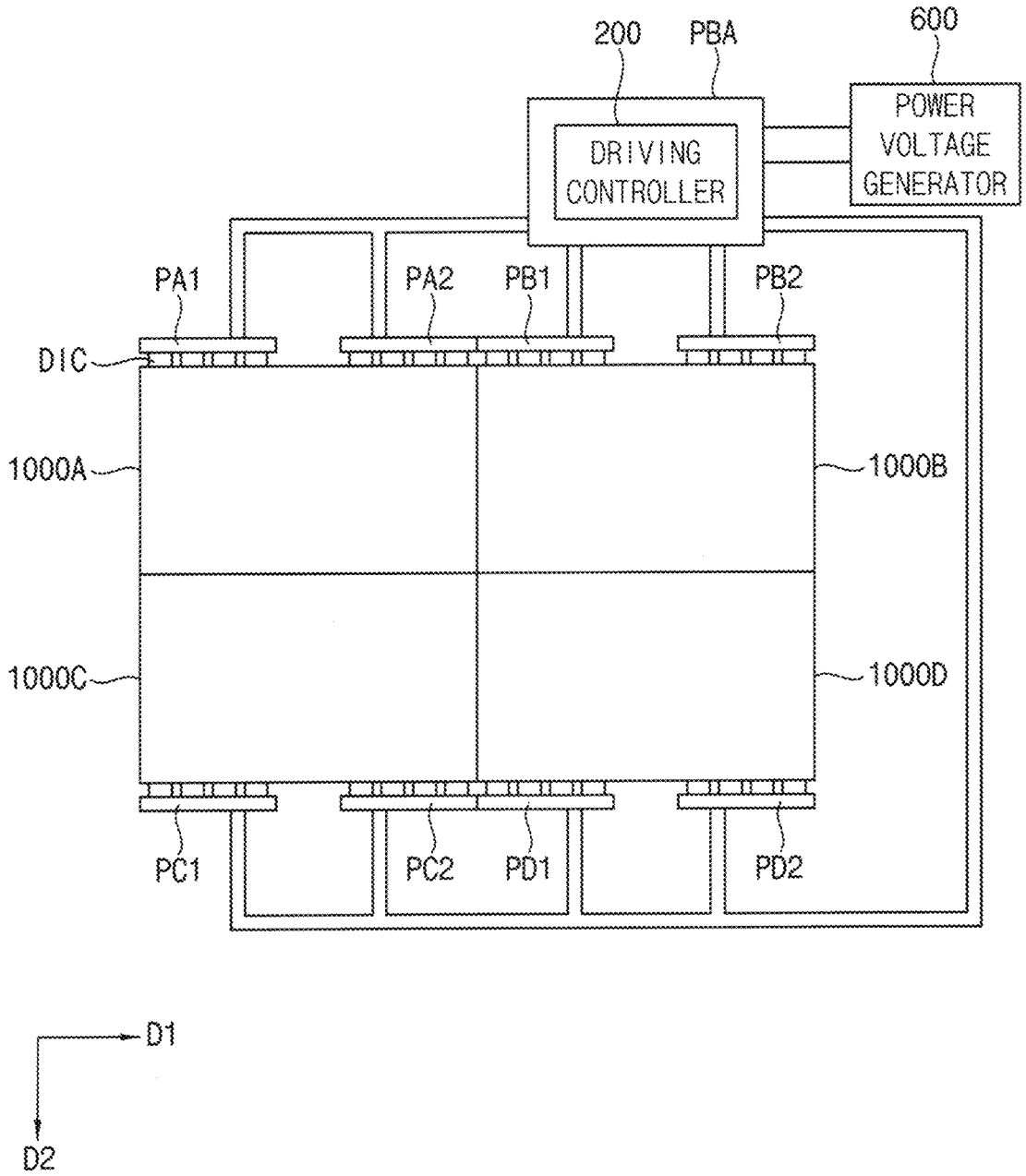
FIG. 1 is a block diagram illustrating an embodiment of a display apparatus according to the invention.

Hereinafter, the invention will be explained in detail with reference to the accompanying drawings.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein. It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Figure 2:
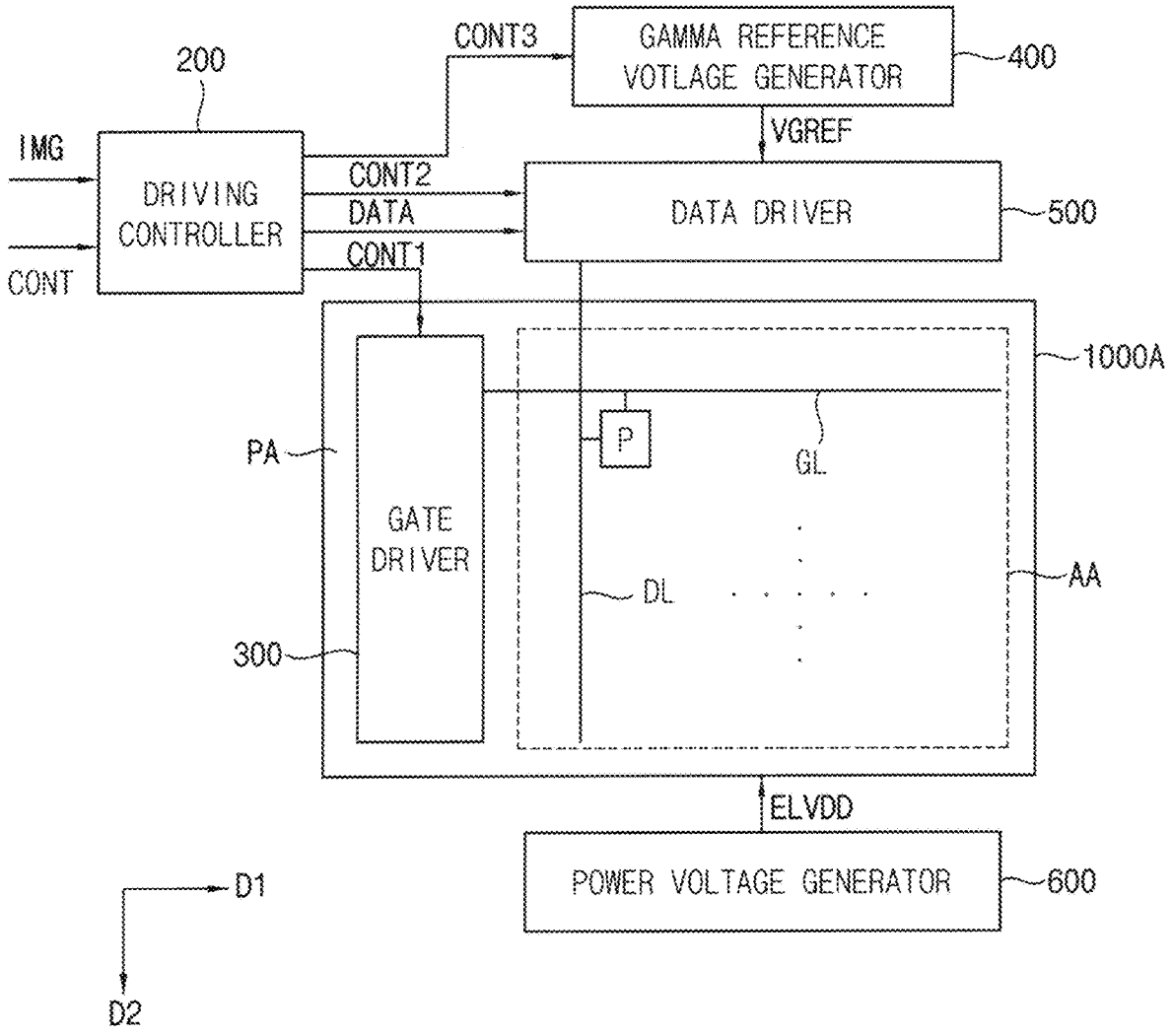
FIG. 2 is a block diagram illustrating an operation of a first display panel of FIG. 1.

FIG. 1 is a block diagram illustrating an embodiment of a display apparatus according to the invention. FIG. 2 is a block diagram illustrating an operation of a first display panel 1000A of FIG. 1.

Referring to FIGS. 1 and 2, the display apparatus includes a plurality of display panels 1000A, 1000B, 1000C and 1000D connected to each other. In the illustrated embodiment, the display apparatus may include four display panels 1000A, 1000B, 1000C and 1000D disposed in two rows and two columns. In an embodiment, the four display panels 1000A, 1000B, 1000C and 1000D may form a large sized television, for example. However, the invention is not limited thereto, and the four display panels 1000A, 1000B, 1000C and 1000D may form various other types of a large sized display apparatus.

In an embodiment, the display panels may include a first display panel 1000A, a second display panel 1000B, a third display panel 1000C and a fourth display panel 1000D which are disposed in two rows and two columns, for example.

The second display panel 1000B may be disposed adjacent to the first display panel 1000A in a first direction D1 (e.g. a horizontal direction). The third display panel 1000C may be disposed adjacent to the first display panel 1000A in a second direction D2 (e.g. a vertical direction). The fourth display panel 1000D may be disposed adjacent to the third display panel 1000C in the first direction D1.

The display apparatus may include a printed circuit board assembly PBA, a first printed circuit PA1, a second printed circuit PA2, a third printed circuit PB1, a fourth printed circuit PB2, a fifth printed circuit PC1, a sixth printed circuit PC2, a seventh printed circuit PD1 and an eighth printed circuit PD2.

The first printed circuit PA1 and the second printed circuit PA2 may be connected to the first display panel 1000A. The third printed circuit PB1 and the fourth printed circuit PB2 may be connected to the second display panel 1000B. The fifth printed circuit PC1 and the sixth printed circuit PC2 may be connected to the third display panel 1000C. The seventh printed circuit PD1 and the eighth printed circuit PD2 may be connected to the fourth display panel 1000D.

The printed circuit board assembly PBA may be connected to the first to eighth printed circuits PA1, PA2, PB1, PB2, PC1, PC2, PD1 and PD2. In an embodiment, the driving controller 200 may be disposed on the printed circuit board assembly PBA, for example.

The display apparatus may include a plurality of flexible circuits connected to the first printed circuit PA1 and the first display panel 1000A. In addition, the display apparatus may include a plurality of flexible circuits connected to the second printed circuit PA2 and the first display panel 1000A. The display apparatus may include a plurality of flexible circuits connected to the third printed circuit PB1 and the second display panel 1000B. In addition, the display apparatus may include a plurality of flexible circuits connected to the fourth printed circuit PB2 and the second display panel 1000B. The display apparatus may include a plurality of flexible circuits connected to the fifth printed circuit PC1 and the third display panel 1000C. In addition, the display apparatus may include a plurality of flexible circuits connected to the sixth printed circuit PC2 and the third display panel 1000C. The display apparatus may include a plurality of flexible circuits connected to the seventh printed circuit PD1 and the fourth display panel 1000D. In addition, the display apparatus may include a plurality of flexible circuits connected to the eighth printed circuit PD2 and the fourth display panel 1000D.

A plurality of data driving chips DIC of the data driver 500 may be respectively disposed in the flexible circuits. The data driving chip DIC may be an integrated circuit chip.

In an embodiment, the data driver 500 of the display apparatus may include the plurality of data driving chips DIC corresponding to one display panel, for example. Although the display apparatus includes eighth data driving chips DIC corresponding to one display panel in FIG. 1, the invention may not be limited to the number of the data driving chips DIC.

As shown in FIG. 1, for example, the display apparatus may include four display panels 1000A, 1000B, 1000C and 1000D, one driving controller 200 and one power voltage generator 600.

Each of the first to fourth display panels 1000A, 1000B, 1000C and 1000D may include a plurality of pixels P.

The operation of one display panel is explained referring to FIG. 2 based on the first display panel 1000A. The operations of the second display panel 1000B, the third display panel 1000C and the fourth display panel 1000D may be substantially the same as the operation of the first display panel 1000A.

The display apparatus includes a display panel (e.g. first display panel 1000A) and a display panel driver. The display panel driver includes a driving controller 200, a gate driver 300, a gamma reference voltage generator 400 and a data driver 500.

The display panel (e.g. the first display panel 1000A) includes a display region AA on which an image is displayed and a peripheral region PA adjacent to the display region AA.

The display panel (e.g. the first display panel 1000A) includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus. In an embodiment, the input image data IMG may include red image data, green image data and blue image data, for example. In an embodiment, the input image data IMG may include white image data, for example. In an embodiment, the input image data IMG may include magenta image data, yellow image data and cyan image data, for example. However, the invention is not limited thereto, and the input image data IMG the input image data IMG may include various other color data. The input control signal CONT may include a master clock signal and a data enable signal. The input control signal CONT may include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. In an embodiment, the gate driver 300 may sequentially output the gate signals to the gate lines GL, for example.

In the illustrated embodiment, the gate driver 300 may be disposed (e.g., integrated) in the peripheral region PA of the display panel (e.g. the first display panel 1000A). In an alternative embodiment, the gate driver 300 may be disposed adjacent to a first side (e.g., left side in FIG. 2) of the display panel (e.g. the first display panel 1000A) and out of the display panel (e.g. the first display panel 1000A) like the data driver 500.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600 may generate a power voltage of the display panel (e.g. the first display panel 1000A). In an embodiment, the display panel (e.g. the first display panel 1000A) includes the pixels P, for example. A high power voltage (e.g. ELVDD) and a low power voltage (e.g. ELVSS) may be applied to the pixels P. The power voltage generator 600 may generate the high power voltage ELVDD applied to the pixels P. In an embodiment, the power voltage generator 600 may generate the low power voltage ELVSS applied to the pixels P, a gate-on voltage and a gate-off voltage of the gate driver 300 and a driving voltage of the data driver 500 and a driving voltage of the driving controller 200, for example.

In an embodiment, the power voltage generator 600 may be disposed out of the printed circuit board assembly PBA, for example. In an alternative embodiment, the power voltage generator 600 may be disposed on the printed circuit board assembly PBA.

Figure 3:
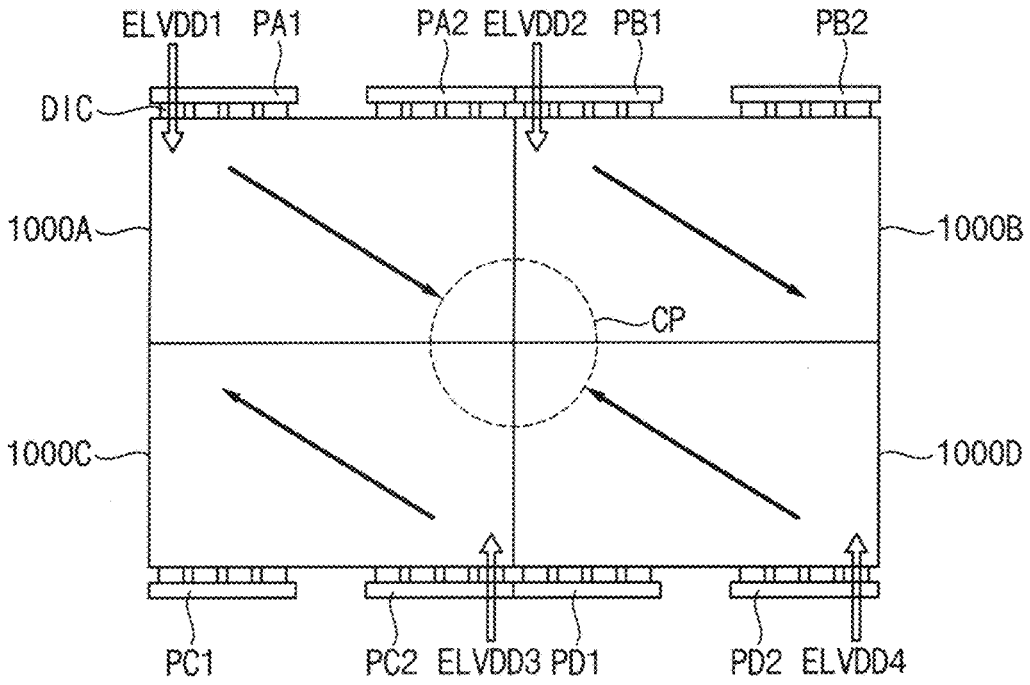
FIG. 3 is a conceptual diagram illustrating directions of applying power voltages to first to fourth display panels of FIG. 1.
Figure 4:
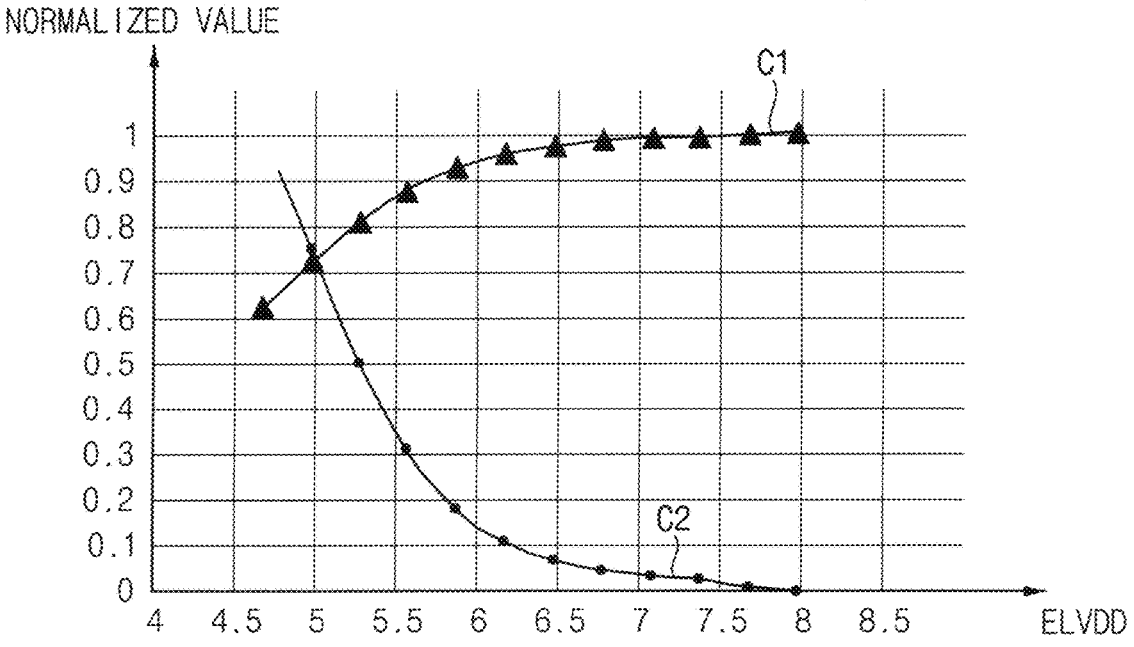
FIG. 4 is a graph illustrating a luminance and a color deviation according to a level of the power voltage of FIG. 3.
Figure 5:
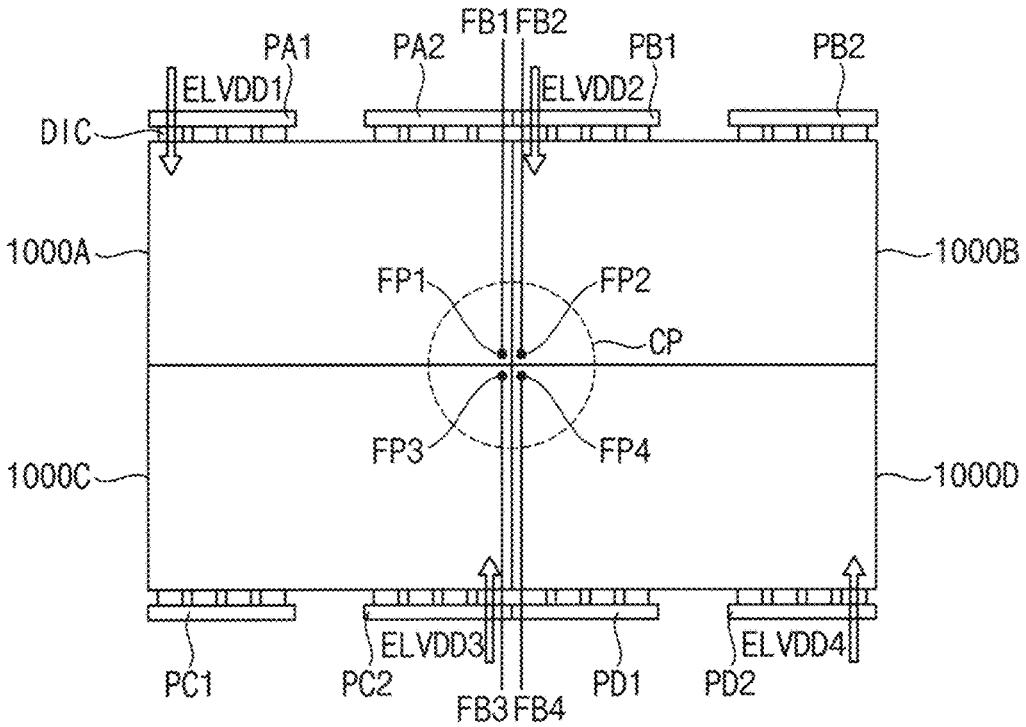
FIG. 5 is a conceptual diagram illustrating feedback points for operating a feedback of the power voltages from the first to fourth display panels of FIG. 1.
Figure 6:
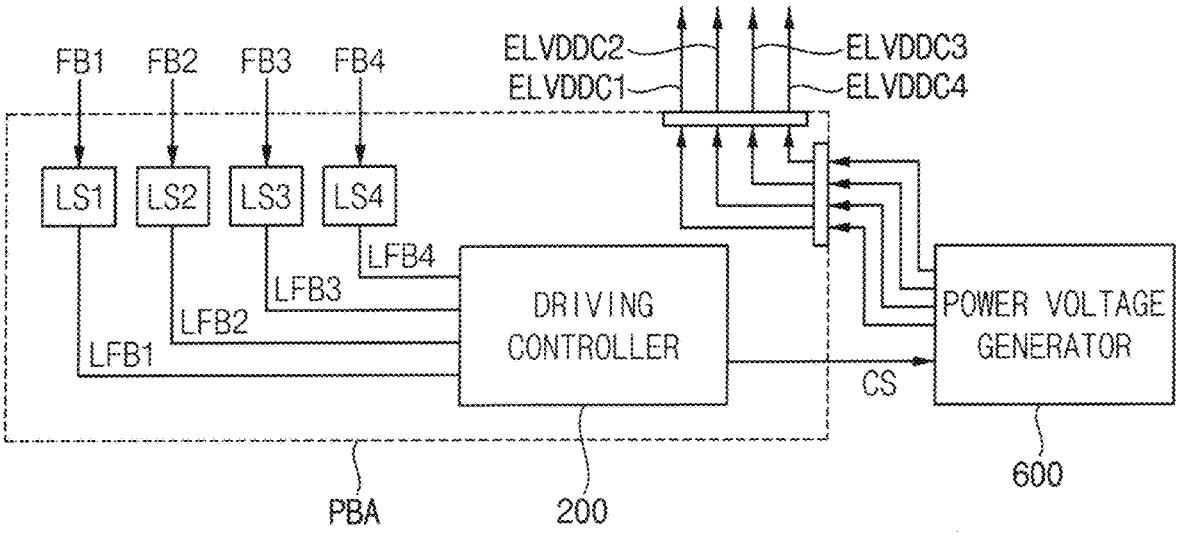
FIG. 6 is a block diagram illustrating an operation of generating a compensation power voltage by a driving controller and a power voltage generator of FIG. 1.

FIG. 3 is a conceptual diagram illustrating directions of applying power voltages to first to fourth display panels 1000A to 1000D of FIG. 1. FIG. 4 is a graph illustrating a luminance and a color deviation according to a level of the power voltage of FIG. 3. FIG. 5 is a conceptual diagram illustrating feedback points FP1, FP2, FP3 and FP4 for operating a feedback of the power voltages from the first to fourth display panels 1000A to 1000D of FIG. 1. FIG. 6 is a block diagram illustrating an operation of generating a compensation power voltage by the driving controller 200 and the power voltage generator 600 of FIG. 1.

Referring to FIGS. 1 to 6, a first power voltage ELVDD1 may be applied from a left upper portion of the first display panel 1000A to a right lower portion of the first display panel 1000A. A second power voltage ELVDD2 may be applied from a left upper portion of the second display panel 1000B to a right lower portion of the second display panel 1000B. A third power voltage ELVDD3 may be applied from a right lower portion of the third display panel 1000C to a left upper portion of the third display panel 1000C. A fourth power voltage ELVDD4 may be applied from a right lower portion of the fourth display panel 1000D to a left upper portion of the fourth display panel 1000D.

In FIG. 4, a luminance graph according to the power voltage ELVDD is represented to C1 and a color deviation graph according to the power voltage ELVDD is represented to C2. As the power voltage ELVDD gradually decreases from an initial level (e.g. about 8.0 volts (V)), the luminance of the display panel (e.g. the first display panel 1000A) gradually decreases. In addition, when the power voltage ELVDD gradually decreases from the initial level (e.g. about 8.0V), the color deviation of the display panel (e.g. the first display panel 1000A) gradually increases.

In a central portion CP of the display apparatus where all of the first to fourth display panels 1000A to 1000D are connected to each other in FIG. 3, the difference of the luminances and the difference of the color deviations may be generated due to a level difference of the first to fourth power voltages ELVDD1 to ELVDD4. Due to the difference of the luminances and the difference of the color deviations, boundaries between the first to fourth display panels 1000A to 1000D may be shown to a user. In FIG. 3, the voltage drop of the power voltages of the first display panel 1000A and the fourth display panel 1000D may be relatively great at the central portion CP according to the applying direction of the power voltage. In contrast, in FIG. 3, the voltage drop of the power voltages of the second display panel 1000B and the third display panel 1000C may be relatively little at the central portion CP according to the applying direction of the power voltage. For this reason, the boundaries between the first to fourth display panels 1000A to 1000D may be more visible to the user while it is preferable that the boundaries between the first to fourth display panels 1000A to 1000D are not shown to the user. When the boundaries between the first to fourth display panels 1000A to 1000D are substantially visible to the user, it may mean that the display quality of the display apparatus is deteriorated.

The driving controller 200 may receive the power voltages from the first to fourth feedback points FP1 to FP4 of the first to fourth display panels 1000A to 1000D, respectively, and may generate a control signal CS to control the levels of the power voltages based on the first to fourth fed-back power voltages FB1 to FB4 from the first to fourth feedback points FP1 to FP4 of the first to fourth display panels 1000A to 1000D respectively.

The power voltage generator 600 may adjust the levels of the power voltages to generate first to fourth compensation power voltages ELVDDC1 to ELVDDC4 based on the control signal CS.

The power voltage generator 600 may output first to fourth compensation power voltages ELVDDC1 to ELVDDC4 to the first to fourth display panels 1000A to 1000D, respectively.

As shown in FIG. 6, the first to fourth compensation power voltages ELVDDC1 to ELVDDC4 may be applied to the first to fourth display panels 1000A to 1000D through pads, respectively, on the printed circuit board assembly PBA where the driving controller 200 is disposed.

In an embodiment, the driving controller 200 may receive a first feedback power voltage FB1 from the first display panel 1000A, a second feedback power voltage FB2 from the second display panel 1000B, a third feedback power voltage FB3 from the third display panel 1000C and a fourth feedback power voltage FB4 from the fourth display panel 1000D, for example.

A first feedback point FP1 of the first display panel 1000A may be disposed at a corner portion of the first display panel 1000A. The corner portion of the first display panel 1000A may be adjacent to the second display panel 1000B, the third display panel 1000C and the fourth display panel 1000D. Similarly, a second feedback point FP2 of the second display panel 1000B may be disposed at a corner portion of the second display panel 1000B which is adjacent to the first display panel 1000A, the third display panel 1000C and the fourth display panel 1000D. Similarly, a third feedback point FP3 of the third display panel 1000C may be disposed at a corner portion of the third display panel 1000C which is adjacent to the first display panel 1000A, the second display panel 1000B and the fourth display panel 1000D. Similarly, a fourth feedback point FP4 of the fourth display panel 1000D may be disposed at a corner portion of the fourth display panel 1000D which is adjacent to the first display panel 1000A, the second display panel 1000B and the third display panel 1000C.

In an embodiment, the display apparatus may further include a first level shifter LS1, a second level shifter LS2, a third level shifter LS3 and a fourth level shifter LS4, for example. The first level shifter LS1 may shift a level of the first feedback power voltage FB1 and may output a level-shifted first feedback power voltage LFB1. The second level shifter LS2 may shift a level of the second feedback power voltage FB2 and may output a level-shifted second feedback power voltage LFB2. The third level shifter LS3 may shift a level of the third feedback power voltage FB3 and may output a level-shifted third feedback power voltage LFB3. The fourth level shifter LS4 may shift a level of the fourth feedback power voltage FB4 and may output a level-shifted fourth feedback power voltage LFB4.

The levels of the first to fourth feedback power voltages FB1 to FB4 may be high to be processed by the driving controller 200 so that the first to fourth level shifters LS1 to LS4 may output the level-shifted first to fourth feedback power voltages LFB1 to LFB4 having decreased levels to the driving controller 200. In an embodiment, the first to fourth level shifters LS1 to LS4 may be omitted.

In the illustrated embodiment, the driving controller 200 may output the control signal CS to the power voltage generator 600. The power voltage generator 600 may generate a first compensation power voltage ELVDDC1 based on the control signal CS and may output the first compensation power voltage ELVDDC1 to the first display panel 1000A. The power voltage generator 600 may generate a second compensation power voltage ELVDDC2 based on the control signal CS and may output the second compensation power voltage ELVDDC2 to the second display panel 1000B. The power voltage generator 600 may generate a third compensation power voltage ELVDDC3 based on the control signal CS and may output the third compensation power voltage ELVDDC3 to the third display panel 1000C. The power voltage generator 600 may generate a fourth compensation power voltage ELVDDC4 based on the control signal CS and may output the fourth compensation power voltage ELVDDC4 to the fourth display panel 1000D.

Figure 7:
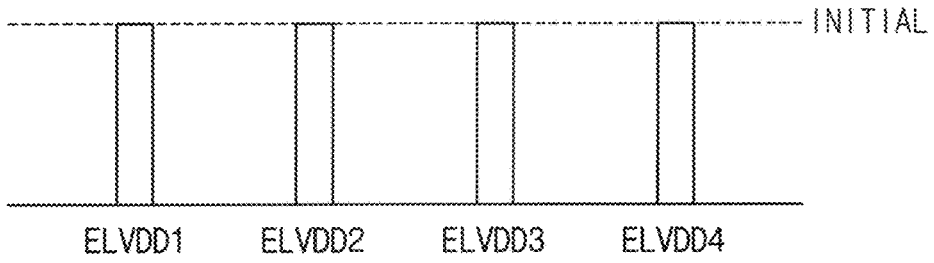
FIG. 7 is a graph illustrating embodiments of first to fourth initial power voltages applied to the first to fourth display panels of FIG. 1.
Figure 8:
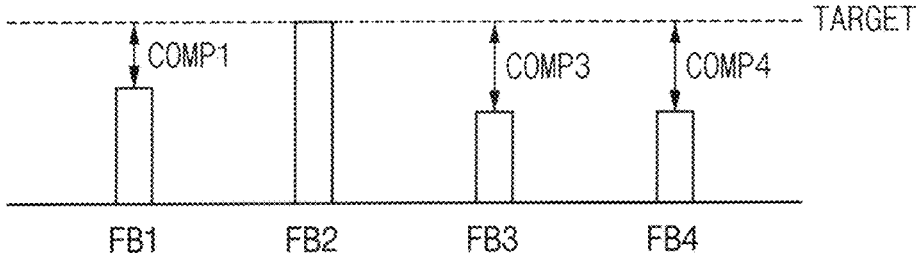
FIG. 8 is a graph illustrating embodiments of first to fourth feedback power voltages fed back from the first to fourth display panels of FIG. 1.
Figure 9:
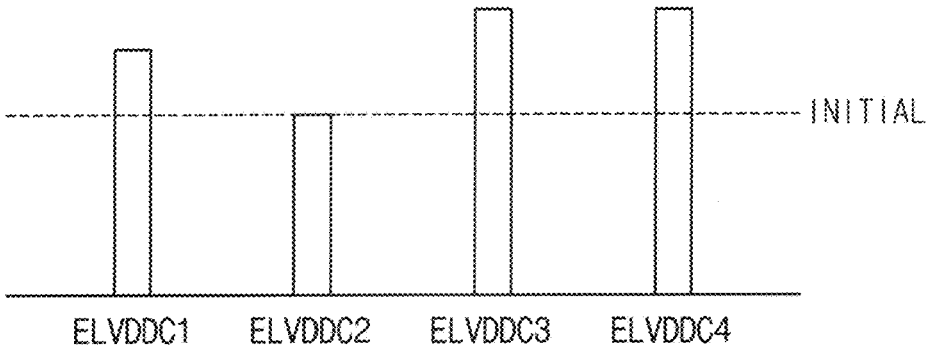
FIG. 9 is a graph illustrating embodiments of first to fourth compensation power voltages applied to the first to fourth display panels of FIG. 1.

FIG. 7 is a graph illustrating embodiments of first to fourth initial power voltages ELVDD1 to ELVDD4 respectively applied to the first to fourth display panels 1000A to 1000D of FIG. 1. FIG. 8 is a graph illustrating embodiments of first to fourth feedback power voltages FB1 to FB4 respectively fed back from the first to fourth display panels 1000A to 1000D of FIG. 1. FIG. 9 is a graph illustrating embodiments of first to fourth compensation power voltages ELVDDC1 to ELVDDC4 respectively applied to the first to fourth display panels 1000A to 1000D of FIG. 1.

Referring to FIGS. 1 to 9, the first to fourth power voltages ELVDD1 to ELVDD4 may be also referred to as the first to fourth initial power voltages ELVDD1 to ELVDD4 which may mean the first to fourth power voltages at a point when the driving controller 200 starts to output the first to fourth power voltages ELVDD1 to ELVDD4. The first to fourth initial power voltages ELVDD1 to ELVDD4 may have the voltage levels (e.g., INITIAL shown in FIG. 4) before the voltage drop between the power voltage generator 600 and the first to fourth display panels 1000A to 1000D is applied or the voltage drop in the first to fourth display panels 1000A to 1000D is applied.

The driving controller 200 may receive the first to fourth feedback power voltages FB1 to FB4 (or first to fourth feedback power voltages LFB1 to LFB4) from the first to fourth feedback points FP1 to FP4, respectively.

The driving controller 200 may determine the maximum voltage among the first to fourth feedback power voltages FB1 to FB4 (or first to fourth feedback power voltages LFB1 to LFB4) as a target value (e.g., TARGET shown in FIG. 8). The power voltage generator 600 may increase levels of the compensation power voltages corresponding to the feedback power voltages less than the maximum voltage based on the target value.

In an embodiment, the second feedback power voltage FB2 is the maximum voltage among the feedback power voltages in FIG. 8, for example. As shown in FIG. 9, the second compensation power voltage ELVDDC2 corresponding to the second feedback power voltage FB2 is not compensated but the levels of the first, third and fourth compensation power voltages ELVDDC1, ELVDDC3 and ELVDDC4 may be respectively increased based on first, third and fourth compensation values COMP1, COMP3 and COMP4 respectively.

Although the power voltages are fed back at the boundaries between the first to fourth display panels 1000A, 1000B, 1000C and 1000D in the illustrated embodiment, the invention may not be limited to the number of the display panels and the number of the feedback points. When the number of the display panels is greater than four, the number of the feedback points may be greater than four. In this case, the feedback points may be disposed corresponding to the boundaries between the display panels.

In the illustrated embodiment, the power voltages are fed back at the boundaries of the first to fourth display panels 1000A, 1000B, 1000C and 1000D, the control signal CS to control the levels of the power voltages are generated based on the first to fourth fed-back power voltages FB1, FB2, FB3 and FB4 and the levels of the power voltages are adjusted to generate the first to fourth compensation power voltages ELVDDC1, ELVDDC2, ELVDDC3 and ELVDDC4 based on the control signal CS in the display apparatus including the plurality of display panels 1000A, 1000B, 1000C and 1000D.

Accordingly, the difference of the luminances and the difference of the color deviations generated at the boundaries of display panels 1000A, 1000B, 1000C and 1000D may be compensated. Thus, the display quality of the display apparatus including the plurality of display panels 1000A, 1000B, 1000C and 1000D may be enhanced.

Figure 10:
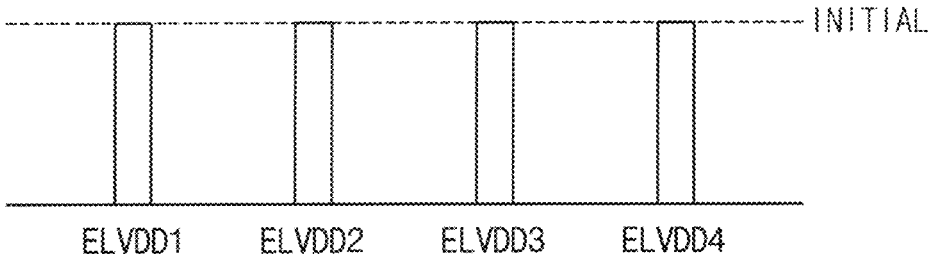
FIG. 10 is a graph illustrating embodiments of first to fourth initial power voltages applied to the first to fourth display panels of FIG. 1.
Figure 11:
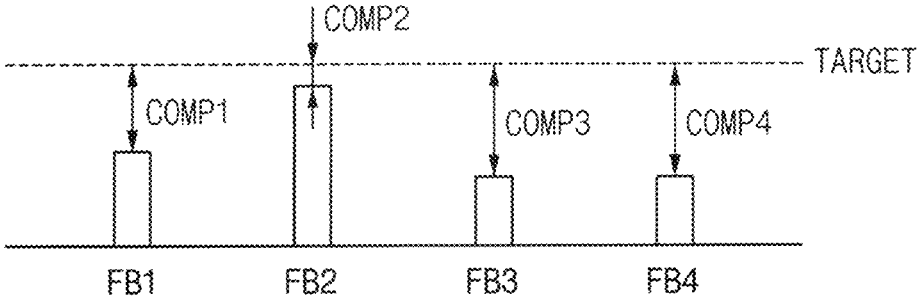
FIG. 11 is a graph illustrating embodiments of first to fourth feedback power voltages fed back from the first to fourth display panels of FIG. 1.
Figure 12:
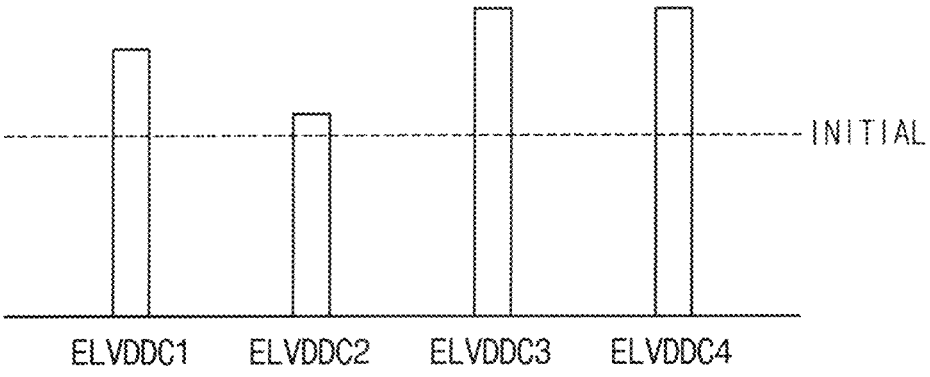
FIG. 12 is a graph illustrating embodiments of first to fourth compensation power voltages applied to the first to fourth display panels of FIG. 1.

FIG. 10 is a graph illustrating embodiments of first to fourth initial power voltages ELVDD1 to ELVDD4 respectively applied to the first to fourth display panels 1000A to 1000D of FIG. 1. FIG. 11 is a graph illustrating embodiments of first to fourth feedback power voltages FB1 to FB4 respectively fed back from the first to fourth display panels 1000A to 1000D of FIG. 1. FIG. 12 is a graph illustrating embodiments of first to fourth compensation power voltages ELVDDC1 to ELVDDC4 respectively applied to the first to fourth display panels 1000A to 1000D of FIG. 1.

Referring to FIGS. 1 to 6 and 10 to 12, in the illustrated embodiment, the driving controller 200 may determine a target value which is greater than the maximum voltage among the first to fourth feedback power voltages FB1 to FB4 (or LFB1 to LFB4). The power voltage generator 600 may increase levels of the compensation power voltages corresponding to the feedback power voltages based on the target value.

In an embodiment, the second feedback power voltage FB2 is the maximum voltage among the feedback power voltages in FIG. 11, for example. The target value may be determined to a value greater than the second feedback power voltage FB2.

As shown in FIG. 12, the levels of first, second, third and fourth compensation power voltages ELVDDC1, ELVDDC2, ELVDDC3 and ELVDDC4 may be respectively increased based on first, second, third and fourth compensation values COMP1, COMP2, COMP3 and COMP4.

In the illustrated embodiment, the power voltages are fed back at the boundaries of the first to fourth display panels 1000A, 1000B, 1000C and 1000D, the control signal CS to control the levels of the power voltages are generated based on the first to fourth fed-back power voltages FB1, FB2, FB3 and FB4 and the levels of the power voltages are adjusted to generate the first to fourth compensation power voltages ELVDDC1, ELVDDC2, ELVDDC3 and ELVDDC4 based on the control signal CS in the display apparatus including the plurality of display panels 1000A, 1000B, 1000C and 1000D.

Accordingly, the difference of the luminances and the difference of the color deviations generated at the boundaries of display panels 1000A, 1000B, 1000C and 1000D may be compensated. Thus, the display quality of the display apparatus including the plurality of display panels 1000A, 1000B, 1000C and 1000D may be enhanced.

Figure 13:
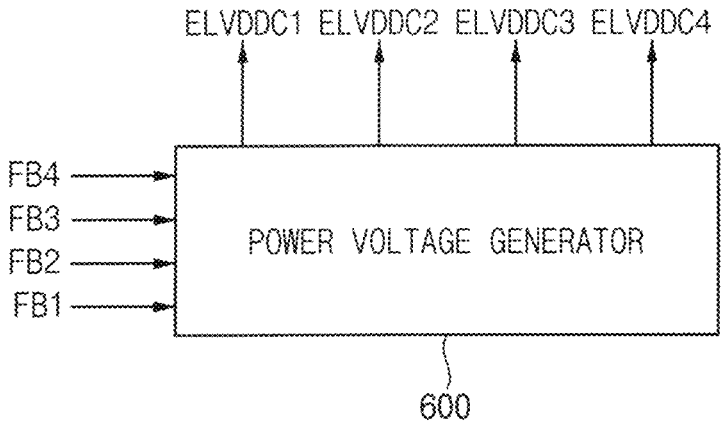
FIG. 13 is a block diagram illustrating an embodiment of an operation of generating a compensation power voltage by a power voltage generator of a display apparatus according to the invention.

FIG. 13 is a block diagram illustrating an embodiment of an operation of generating a compensation power voltage ELVDDC1, ELVDDC2, ELVDDC3 and ELVDDC4 by a power voltage generator 600 of a display apparatus according to the invention.

The display apparatus and the method of driving the display apparatus in the illustrated embodiment are substantially the same as the display apparatus and the method of driving the display apparatus of the previous embodiment explained referring to FIGS. 1 to 9 except that the compensation of the power voltage is operated not by the driving controller but by the power voltage generator. Thus, the same reference numerals will be used to refer to the same or like parts as those described in the previous embodiment of FIGS. 1 to 9 and any repetitive explanation concerning the above elements will be omitted.

Referring to FIGS. 1 to 5 and 7 to 13, the display apparatus includes a plurality of display panels 1000A, 1000B, 1000C and 1000D and a power voltage generator 600. The power voltage generator 600 generates power voltages ELVDD1, ELVDD2, ELVDD3 and ELVDD4 of the first to fourth display panels 1000A, 1000B, 1000C and 1000D, respectively. The power voltage generator 600 may receive the power voltages from the first to fourth feedback points FP1, FP2, FP3 and FP4 of the first to fourth display panels 1000A to 1000D, respectively, and may adjust the levels of the power voltages to generate first to fourth compensation power voltages ELVDDC1, ELVDDC2, ELVDDC3 and ELVDDC4 based on the first to fourth fed-back power voltages FB1, FB2, FB3 and FB4 from the first to fourth feedback points FP1, FP2, FP3 and FP4 of the first to fourth display panels 1000A to 1000D respectively.

In the illustrated embodiment, the compensation of the power voltage ELVDD may be operated not by the driving controller 200 but by the power voltage generator 600.

In an embodiment, the display panels may include a first display panel 1000A, a second display panel 1000B, a third display panel 1000C and a fourth display panel 1000D which are disposed in two rows and two columns, for example.

The power voltage generator 600 may receive a first feedback power voltage FB1 from the first display panel 1000A, a second feedback power voltage FB2 from the second display panel 1000B, a third feedback power voltage FB3 from the third display panel 1000C and a fourth feedback power voltage FB4 from the fourth display panel 1000D. In the illustrated embodiment, the display apparatus may not include the first to fourth level shifters LS1 to LS4 illustrated in FIG. 6.

A first feedback point FP1 of the first display panel 1000A may be disposed at a corner portion of the first display panel 1000A. The corner portion of the first display panel 1000A may be adjacent to the second display panel 1000B, the third display panel 1000C and the fourth display panel 1000D. Similarly, second to fourth feedback points FP2, FP3 and FP4 of the second to fourth display panels 1000B, 1000C and 1000D may be disposed at corner portions which are adjacent to the boundaries of the first to fourth display panels 1000A to 1000D.

In the illustrated embodiment, the power voltages are fed back at the boundaries of the first to fourth display panels 1000A, 1000B, 1000C and 1000D, the levels of the power voltages are adjusted to generate the first to fourth compensation power voltages ELVDDC1, ELVDDC2, ELVDDC3 and ELVDDC4 based on the first to fourth fed-back power voltages FB1, FB2, FB3 and FB4 in the display apparatus including the plurality of display panels 1000A, 1000B, 1000C and 1000D, respectively.

Accordingly, the difference of the luminances and the difference of the color deviations generated at the boundaries of display panels 1000A, 1000B, 1000C and 1000D may be compensated. Thus, the display quality of the display apparatus including the plurality of display panels 1000A, 1000B, 1000C and 1000D may be enhanced.

Figure 14:
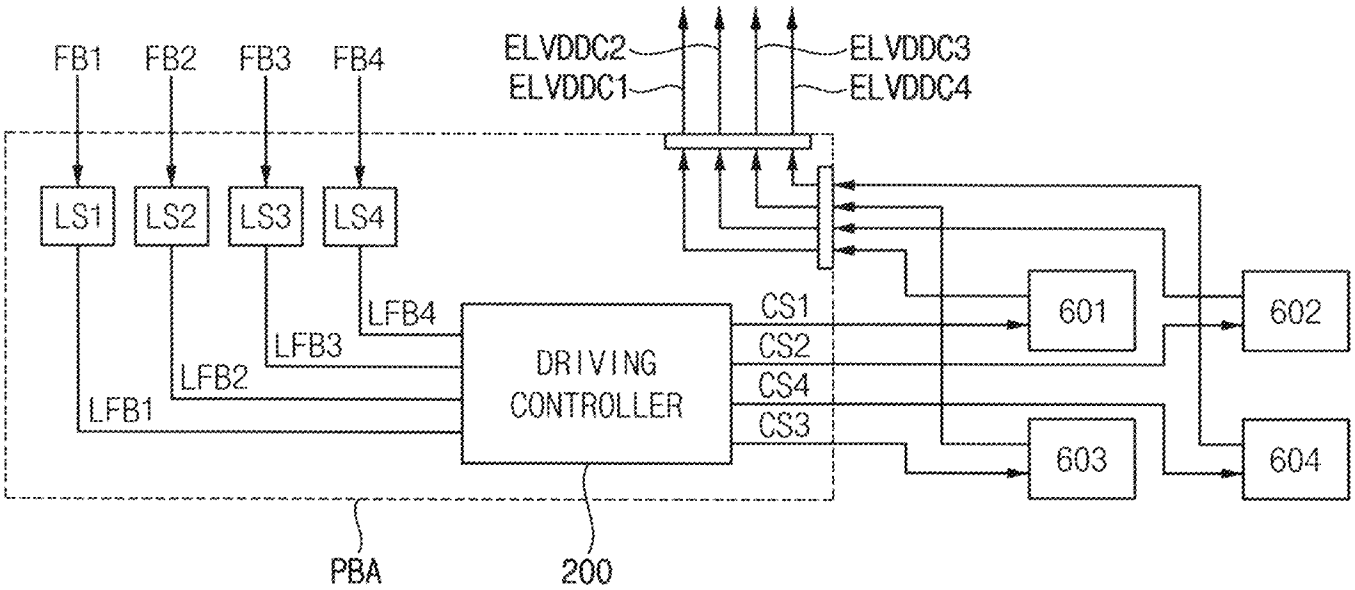
FIG. 14 is a block diagram illustrating an embodiment of an operation of generating a compensation power voltage by a driving controller and a power voltage generator of a display apparatus according to the invention.

FIG. 14 is a block diagram illustrating an embodiment of an operation of generating a compensation power voltage by a driving controller 200 and power voltage generators 601, 602, 603 and 604 of a display apparatus according to the invention.

The display apparatus and the method of driving the display apparatus in the illustrated embodiment are substantially the same as the display apparatus and the method of driving the display apparatus of the previous embodiment explained referring to FIGS. 1 to 9 except that the power voltage generator includes first to fourth power voltage generators. Thus, the same reference numerals will be used to refer to the same or like parts as those described in the previous embodiment of FIGS. 1 to 9 and any repetitive explanation concerning the above elements will be omitted.

Referring to FIGS. 1 to 5, 7 to 12 and 14, for example, the display apparatus may include four display panels 1000A, 1000B, 1000C and 1000D, one driving controller 200 and four power voltage generators 601, 602, 603 and 604.

The driving controller 200 may output a first control signal CS1, a second control signal CS2, a third control signal CS3 and a fourth control signal CS4 to the power voltage generator 600.

In the illustrated embodiment, the power voltage generator 600 may include a first power voltage generator 601, a second power voltage generator 602, a third power voltage generator 603 and a fourth power voltage generator 604. The first power voltage generator 601 may generate a first compensation power voltage ELVDDC1 based on the first control signal CS1 and may output the first compensation power voltage ELVDDC1 to the first display panel 1000A. The second power voltage generator 602 may generate a second compensation power voltage ELVDDC2 based on the second control signal CS2 and may output the second compensation power voltage ELVDDC2 to the second display panel 1000B. The third power voltage generator 603 may generate a third compensation power voltage ELVDDC3 based on the third control signal CS3 and may output the third compensation power voltage ELVDDC3 to the third display panel 1000C. The fourth power voltage generator 604 may generate a fourth compensation power voltage ELVDDC4 based on the fourth control signal CS4 and may output the fourth compensation power voltage ELVDDC4 to the fourth display panel 1000D.

Figure 15:
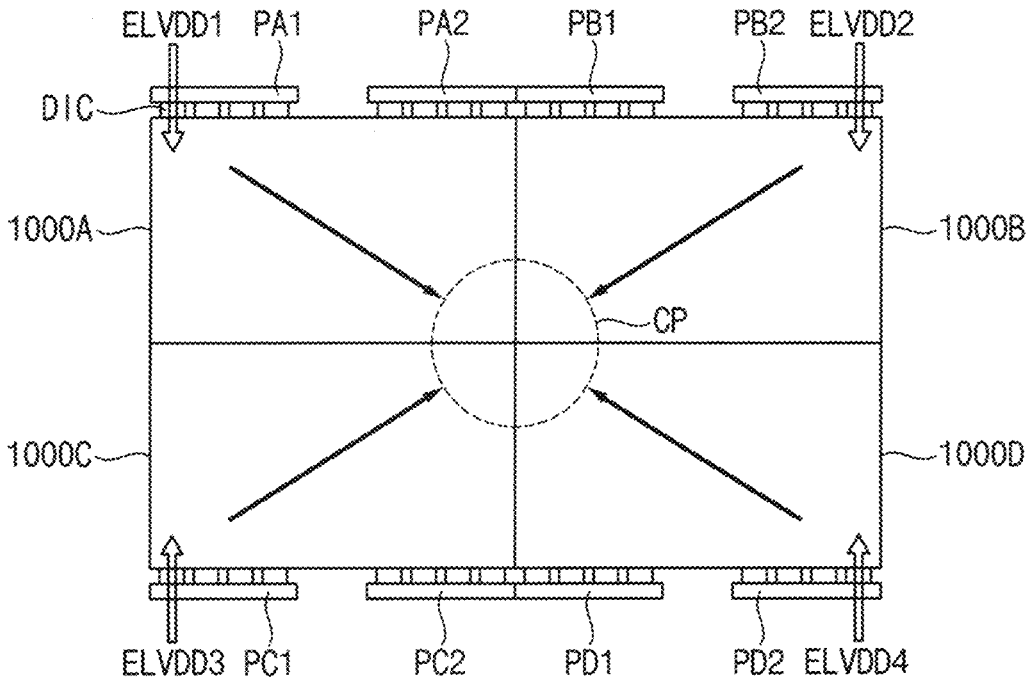
FIG. 15 is a conceptual diagram illustrating an embodiment of directions of applying power voltages to first to fourth display panels of a display apparatus according to the invention.

FIG. 15 is a conceptual diagram illustrating an embodiment of directions of applying power voltages to first to fourth display panels of a display apparatus according to the invention.

The display apparatus and the method of driving the display apparatus in the illustrated embodiment are substantially the same as the display apparatus and the method of driving the display apparatus of the previous embodiment explained referring to FIGS. 1 to 9 except for the directions of applying the power voltages to first to fourth display panels. Thus, the same reference numerals will be used to refer to the same or like parts as those described in the previous embodiment of FIGS. 1 to 9 and any repetitive explanation concerning the above elements will be omitted.

Referring to FIG. 15, in the illustrated embodiment, the second display panel 1000B may be disposed adjacent to the first display panel 1000A in a first direction D1 (e.g. a horizontal direction). The third display panel 1000C may be disposed adjacent to the first display panel 1000A in a second direction D2 (e.g. a vertical direction). The fourth display panel 1000D may be disposed adjacent to the third display panel 1000C in the first direction D1.

A first power voltage ELVDD1 may be applied from a left upper portion of the first display panel 1000A to a right lower portion of the first display panel 1000A. A second power voltage ELVDD2 may be applied from a right upper portion of the second display panel 1000B to a left lower portion of the second display panel 1000B. A third power voltage ELVDD3 may be applied from a left lower portion of the third display panel 1000C to a right upper portion of the third display panel 1000C. A fourth power voltage ELVDD4 may be applied from a right lower portion of the fourth display panel 1000D to a left upper portion of the fourth display panel 1000D.

In a central portion CP of the display apparatus where all of the first to fourth display panels 1000A to 1000D are connected to each other in FIG. 15, the difference of the luminances and the difference of the color deviations may be generated due to a level difference of the first to fourth power voltages ELVDD1 to ELVDD4. Due to the difference of the luminances and the difference of the color deviations, boundaries between the first to fourth display panels 1000A to 1000D may be shown to a user. In FIG. 15, the power voltages are applied from the four outermost corners to the central portion CP of the display apparatus so that the voltage drops of the power voltages of the first to fourth display panels 1000A to 1000D may be more uniform at the central portion CP compared to the embodiment of FIG. 3. Thus, the boundaries of the first to fourth display panels 1000A to 1000D may be relatively weakly shown to a user in the illustrated embodiment.

According to the display apparatus and the method of driving the display apparatus of the invention as explained above, the display quality of the display apparatus may be enhanced.

The foregoing is illustrative of the invention and is not to be construed as limiting thereof. Although a few embodiments of the invention have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the predetermined embodiments disclosed, and that modifications to the disclosed embodiments, as well as other embodiments.

What is claimed is:

1. A display apparatus comprising:

a plurality of display panels;

a power voltage generator which generates power voltages of the plurality of display panels, respectively; and a driving controller which receives the power voltages from feedback points of the plurality of display panels, generates a control signal and controls levels of the power voltages based on fed-back power voltages from the feedback points of the plurality of display panels, wherein the power voltage generator adjusts the levels of the power voltages, generates compensation power voltages based on the control signal and applies the compensation power voltages to the plurality of display panels through a plurality of power lines, respectively, wherein the driving controller determines a maximum voltage among the fed-back power voltages as a target value, and wherein the power voltage generator increases levels of the compensation power voltages corresponding to the fed-back power voltages less than the maximum voltage based on the target value.

2. The display apparatus of claim 1, wherein the plurality of display panels includes a first display panel, a second display panel, a third display panel and a fourth display panel which are disposed in two rows and two columns, and wherein the driving controller receives a first feedback power voltage from the first display panel, a second feedback power voltage from the second display panel, a third feedback power voltage from the third display panel and a fourth feedback power voltage from the fourth display panel.

3. The display apparatus of claim 2, wherein a first feedback point of the first display panel is disposed at a corner portion of the first display panel, and wherein the corner portion of the first display panel is adjacent to the second display panel, the third display panel and the fourth display panel.

4. The display apparatus of claim 2, wherein the second display panel is disposed adjacent to the first display panel in a first direction, the third display panel is disposed adjacent to the first display panel in a second direction different from the first direction, and the fourth display panel is disposed adjacent to the third display panel in the first direction, and wherein a first power voltage is applied from a first corner portion of the first display panel to a second corner portion of the first display panel where the second corner portion of the first display panel is adjacent to the second, third and fourth display panels and the first corner portion of the first display panel is opposite to the second corner portion of the first display panel in a third direction between the first and second directions, a second power voltage is applied from a first corner portion of the second display panel to a second corner portion of the second display panel where the first corner portion of the second display panel is adjacent to the first display panel and aligned with the first corner portion of the first display panel in the first direction, and the second corner portion of the second display panel is opposite to the first corner portion of the second display panel in the third direction, a third power voltage is applied from a first corner portion of the third display panel to a second corner portion of the third display panel where the second corner portion of the third display panel is adjacent to the first display panel and aligned with the first corner portion of the first display panel in the second direction, and the first corner portion of the third display panel is opposite to the second corner portion of the third display panel in the third direction, and a fourth power voltage is applied from a first corner portion of the fourth display panel to a second corner portion of the fourth display panel where the second corner portion of the fourth display panel is adjacent to the second display panel and aligned with the first corner portion of the second display panel in the second direction, and the first corner portion of the fourth display panel is opposite to the second corner portion of the fourth display panel in the third direction.

5. The display apparatus of claim 2, wherein the second display panel is disposed adjacent to the first display panel in a first direction, the third display panel is disposed adjacent to the first display panel in a second direction different from the first direction, and the fourth display panel is disposed adjacent to the third display panel in the first direction, and wherein a first power voltage is applied from a first corner portion of the first display panel to a second corner portion of the first display panel where the second corner portion of the first display panel is adjacent to the second, third and fourth display panels and the first corner portion of the first display panel is opposite to the second corner portion of the first display panel in a third direction between the first and second directions, a second power voltage is applied from a first corner portion of the second display panel to a second corner portion of the second display panel where the second corner portion of the second display panel is adjacent to the first, third and fourth display panels and the first corner portion of the second display panel is opposite to the first corner portion of the second display panel in the third direction, a third power voltage is applied from a first corner portion of the third display panel to a second corner portion of the third display panel where the second corner portion of the third display panel is adjacent to the first, second and fourth display panels and the first corner portion of the third display panel is opposite to the first corner portion of the second display panel in the third direction, and a fourth power voltage is applied from a first corner portion of the fourth display panel to a second corner portion of the fourth display panel where the second corner portion of the fourth display panel is adjacent to the first, second and third display panels and the first corner portion of the fourth display panel is opposite to the first corner portion of the second display panel in the third direction.

6. The display apparatus of claim 2, further comprising:

a first level shifter which shifts a level of the first feedback power voltage and outputs a level-shifted first feedback power voltage to the driving controller;

a second level shifter which shifts a level of the second feedback power voltage and outputs a level-shifted second feedback power voltage to the driving controller;

a third level shifter which shifts a level of the third feedback power voltage and outputs a level-shifted third feedback power voltage to the driving controller; and a fourth level shifter which shifts a level of the fourth feedback power voltage and outputs a level-shifted fourth feedback power voltage to the driving controller.

7. The display apparatus of claim 6, wherein the driving controller outputs the control signal to the power voltage generator, wherein the power voltage generator generates a first compensation power voltage based on the control signal and outputs the first compensation power voltage to the first display panel, wherein the power voltage generator generates a second compensation power voltage based on the control signal and outputs the second compensation power voltage to the second display panel, wherein the power voltage generator generates a third compensation power voltage based on the control signal and outputs the third compensation power voltage to the third display panel, and wherein the power voltage generator generates a fourth compensation power voltage based on the control signal and outputs the fourth compensation power voltage to the fourth display panel.

8. The display apparatus of claim 6, wherein the driving controller outputs a first control signal, a second control signal, a third control signal and a fourth control signal, and wherein the power voltage generator comprises:

a first power voltage generator which generates a first compensation power voltage based on the first control signal and outputs the first compensation power voltage to the first display panel;

a second power voltage generator which generates a second compensation power voltage based on the second control signal and outputs the second compensation power voltage to the second display panel;

a third power voltage generator which generates a third compensation power voltage based on the third control signal and outputs the third compensation power voltage to the third display panel; and a fourth power voltage generator which generates a fourth compensation power voltage based on the fourth control signal and outputs the fourth compensation power voltage to the fourth display panel.

9. The display apparatus of claim 1, further comprising a level shifter which receives a fed-back power voltage of the fed-back power voltages, shifts a level of the fed-back power voltage and outputs a level-shifted power voltage to the driving controller.

10. The display apparatus of claim 1, wherein a display panel of the plurality of display panels comprises a plurality of pixels, wherein a high power voltage and a low power voltage are applied to the plurality of pixels, and wherein a power voltage of the power voltages is the high power voltage applied to the plurality of pixels.

11. A display apparatus comprising:

a plurality of display panels;

a power voltage generator which generates power voltages of the plurality of display panels, respectively; and a driving controller which receives the power voltages from feedback points of the plurality of display panels, generates a control signal and controls levels of the power voltages based on fed-back power voltages from the feedback points of the plurality of display panels, wherein the power voltage generator adjusts the levels of the power voltages, generates compensation power voltages based on the control signal and applies the compensation power voltages to the plurality of display panels through a plurality of power lines, respectively, wherein the driving controller determines a target value which is greater than a maximum voltage among the fed-back power voltages, and wherein the power voltage generator increases levels of the compensation power voltages based on the target value.

12. A display apparatus comprising:

a plurality of display panels; and a power voltage generator which generates power voltages of the plurality of display panels, respectively, wherein the power voltage generator receives the power voltages from feedback points of the plurality of display panels, adjusts levels of the power voltages, generates compensation power voltages based on fed-back power voltages from the feedback points of the plurality of display panels, and applies the compensation power voltages to the plurality of display panels through a plurality of power lines, respectively, wherein the power voltage generator determines a maximum voltage among the fed-back power voltages as a target value, and wherein the power voltage generator increases levels of the compensation power voltages corresponding to the fed-back power voltages less than the maximum voltage based on the target value.

13. The display apparatus of claim 12, wherein the plurality of display panels include a first display panel, a second display panel, a third display panel and a fourth display panel which are disposed in two rows and two columns, and wherein the power voltage generator receives a first feedback power voltage from the first display panel, a second feedback power voltage from the second display panel, a third feedback power voltage from the third display panel and a fourth feedback power voltage from the fourth display panel.

14. The display apparatus of claim 13, wherein a first feedback point of the first display panel is disposed at a corner portion of the first display panel, and wherein the corner portion of the first display panel is adjacent to the second display panel, the third display panel and the fourth display panel.

15. A method of driving a display apparatus comprising a plurality of display panels, the method comprises:

generating power voltages of the plurality of display panels, respectively;

outputting the power voltages to the plurality of display panels;

receiving the power voltages from feedback points of the plurality of display panels;

generating a control signal to control levels of the power voltages based on fed-back power voltages from the feedback points of the plurality of display panels;

adjusting the levels of the power voltages to generate compensation power voltages based on the control signal; and outputting the compensation power voltages to the plurality of display panels through a plurality of power lines, respectively, determining a maximum voltage among the fed-back power voltages as a target value, and wherein levels of the compensation power voltages corresponding to the fed-back power voltages less than the maximum voltage are increased based on the target value.

16. The method of claim 15, further comprising:

shifting a level of the feedback power voltage; and outputting a level-shifted power voltage to a driving controller.

17. The method of claim 15, wherein a display panel of the plurality of display panels comprises a plurality of pixels, wherein a high power voltage and a low power voltage are applied to the plurality of pixels, and wherein the power voltage is the high power voltage applied to the plurality of pixels.

18. A method of driving a display apparatus comprising a plurality of display panels, the method comprises:

generating power voltages of the plurality of display panels, respectively;

outputting the power voltages to the plurality of display panels;

receiving the power voltages from feedback points of the plurality of display panels;

generating a control signal to control levels of the power voltages based on fed-back power voltages from the feedback points of the plurality of display panels;

adjusting the levels of the power voltages to generate compensation power voltages based on the control signal;

outputting the compensation power voltages to the plurality of display panels through a plurality of power lines, respectively, determining a target value which is greater than a maximum voltage among the fed-back power voltages, and wherein levels of the compensation power voltages are increased based on the target value.

* * * * *